US009791827B2

(12) United States Patent
Shinoya

(10) Patent No.: US 9,791,827 B2
(45) Date of Patent: Oct. 17, 2017

(54) IMAGE FORMING APPARATUS INCLUDING CARTRIDGE FOR PROTECTING PHOTOSENSITIVE DRUM

(71) Applicant: Shota Shinoya, Nagoya-shi (JP)

(72) Inventor: Shota Shinoya, Nagoya-shi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/191,830

(22) Filed: Feb. 27, 2014

(65) Prior Publication Data

US 2014/0241736 A1 Aug. 28, 2014

(30) Foreign Application Priority Data

Feb. 28, 2013 (JP) ..... 2013-039825

(51) Int. Cl.
*G03G 21/18* (2006.01)

(52) U.S. Cl.
CPC ..... *G03G 21/1832* (2013.01); *G03G 21/1842* (2013.01); *G03G 21/1871* (2013.01); *G03G 21/1878* (2013.01); *G03G 21/1885* (2013.01); *G03G 2215/0141* (2013.01); *G03G 2215/0875* (2013.01); *G03G 2221/1807* (2013.01)

(58) Field of Classification Search
CPC ..... G03G 21/1832; G03G 21/1842; G03G 21/1821; G03G 21/1885; G03G 2215/0875; G03G 2221/1807
See application file for complete search history.

(56) References Cited

U.S. PATENT DOCUMENTS 4,965,633 A * 10/1990 Surti ..... 399/114
5,666,608 A * 9/1997 Christensen ..... G03G 15/025 399/115
2005/0025522 A1* 2/2005 Tsuzuki et al. ..... 399/111
(Continued)

FOREIGN PATENT DOCUMENTS

JP H09-81012 A 3/1997
JP 2005-055579 3/2005
(Continued)

OTHER PUBLICATIONS

Sep. 20, 2016—(JP) Office Action—App 2013-039825, Eng Tran.

*Primary Examiner* — David M Gray
*Assistant Examiner* — Laura Roth
(74) *Attorney, Agent, or Firm* — Banner & Witcoff, Ltd.

(57) ABSTRACT

An image forming apparatus includes a main body and a cartridge attached to the main body. The cartridge includes: a casing extending in a longitudinal direction; a photosensitive drum extending in the longitudinal direction; and a separating member that is detachably attached to the casing. The photosensitive drum has a peripheral surface and is positioned in confrontation with the endless belt as a result of attachment of the cartridge to the main body. The separating member is attached to the casing and separates the photosensitive drum from the endless belt when the main body is packaged while the cartridge is attached to the main body. The separating member includes first and second end portions disposed on both end portions of the casing, and a connecting portion connecting the first and second end portions and is configured to cover the peripheral surface.

7 Claims, 8 Drawing Sheets

(56) References Cited

U.S. PATENT DOCUMENTS

| | | | | |
|---|---|---|---|---|
| 2010/0054797 | A1* | 3/2010 | Takeyama et al. | 399/111 |
| 2010/0054799 | A1* | 3/2010 | Nakamura et al. | 399/114 |
| 2010/0080621 | A1* | 4/2010 | Itabashi | 399/114 |
| 2012/0177407 | A1* | 7/2012 | Lee G03G 21/1814 | 399/168 |

FOREIGN PATENT DOCUMENTS

| | | | | |
|---|---|---|---|---|
| JP | 2005-091708 | A | | 4/2005 |
| JP | 2006-154614 | A | | 6/2006 |
| JP | 2006154614 | A | * | 6/2006 |
| JP | 2009-086141 | A | | 4/2009 |
| JP | 2011075654 | A | * | 4/2011 |

* cited by examiner

IMAGE FORMING APPARATUS INCLUDING CARTRIDGE FOR PROTECTING PHOTOSENSITIVE DRUM

CROSS REFERENCE TO RELATED APPLICATION

This application claims priority from Japanese Patent Application No. 2013-039825 filed Feb. 28, 2013. The entire content of each of these priority applications is incorporated herein by reference. The entire content of the priority application is incorporated herein by reference.

TECHNICAL FIELD

The present invention relates to an image forming apparatus and a cartridge.

BACKGROUND

An image-forming device having replaceable cartridges is well known in the art. Each cartridge has a photosensitive member and is detachably mounted in the image-forming device. When shipping and transporting this type of image-forming device, it is necessary to separate the photosensitive members from corresponding transfer members. Accordingly, the cartridges are removed from the image-forming device and packaged separately from the same. However, packaging the cartridges separately from the image-forming device increases the overall size of the packing container.

Therefore, an image-forming device capable of reducing the package size has been proposed in Japanese unexamined patent application publication No. 2006-154614. This image-forming device is configured with a pressing member mounted on each cartridge for separating the photosensitive drum in the cartridge from the transfer roller in the device body when the cartridge is mounted in the image-forming device. In this way, the cartridges with pressing members attached can be mounted in and packaged together with the image-forming device to yield a smaller package.

SUMMARY

However, while the pressing member in the conventional image-forming device described above maintains separation between the photosensitive drum and corresponding transfer roller, the photosensitive drum is left exposed. Therefore, the photosensitive drums cannot be reliably protected if the image-forming device is subjected to vibrations or impacts during shipping and transport. The photosensitive drums may also become soiled or damaged through contact with other members when the cartridge is mounted in and removed from the image-forming device.

In view of the foregoing, it is an object of the present invention to provide a cartridge for an image-forming device that is capable of preventing contact between a photosensitive drum and other members in the device, and that is capable of suppressing damage to the photosensitive drum and the deposition of foreign matter thereon. It is another object of the present invention to provide an image-forming device equipped with these cartridges.

In order to attain the above and other objects, the invention provides an image forming apparatus including a main body and a cartridge. The main body includes an endless belt. The cartridge is attached to the main body and includes a casing, a photosensitive drum, and a separating member. The casing extends in a longitudinal direction and has one end portion and another end portion in the longitudinal direction. The photosensitive drum is supported by the casing and extends in the longitudinal direction. The photosensitive drum has a peripheral surface and is positioned in confrontation with the endless belt as a result of attachment of the cartridge to the main body. The separating member is attached to the casing and separates the photosensitive drum from the endless belt when the main body is packaged while the cartridge is attached to the main body. The separating member includes: a first end portion disposed on the one end portion; a second end portion disposed on the other end portion; and a connecting portion connecting the first end portion and the second end portion. The connecting portion is configured to cover the peripheral surface.

According to another aspect, the present invention provides a cartridge including a casing, a photosensitive drum, a process unit, a drive receiving portion, an electrical contact, and a covering member. The casing extends in a longitudinal direction and has one end portion and another end portion in the longitudinal direction. The photosensitive drum is supported by the casing and extends in the longitudinal direction. The photosensitive drum has a peripheral surface. The process unit is supported by the casing and is configured to form an image on the peripheral surface. The drive receiving portion is disposed on the one end portion, and is configured to receive a drive force from an external drive source and to transmit the drive force to the photosensitive drum. The electrical contact is disposed on the other end portion and is configured to supply electrical power to the process unit from an external power source. The covering member has a first end portion, a second end portion, and a connecting portion. The first end portion is configured to protect the drive receiving portion. The second end portion is configured to protect the electrical contact. The connecting portion connects the first end portion and the second end portion and is configured to cover the peripheral surface of the photosensitive drum.

According to another aspect, the present invention provides an image forming apparatus includes a main body and a cartridge. The main body includes an endless belt. The cartridge is attached to the main body and includes a photosensitive drum, a casing, and a cover. The photosensitive drum has a peripheral surface and is positioned in confrontation with the endless belt. The casing supports the photosensitive drum. The casing includes a first side-wall and a second side-wall opposite to the first side-wall. The cover is configured to be detachably attached to the casing. The cover includes a first plate portion, a second plate portion, and a cover portion. The first plate portion extends in the second direction and opposes the first side-wall. The second plate portion extends in the second direction and opposes the second side-wall. The cover portion is configured to cover at least a part of the peripheral surface of the photosensitive drum and connects the first plate portion and the second plate portion. The cover portion is disposed on a position that is between the photosensitive drum and the endless belt.

BRIEF DESCRIPTION OF THE DRAWINGS

The particular features and advantages of the invention as well as other objects will become apparent from the following description taken in connection with the accompanying drawings, in which.

DETAILED DESCRIPTION

1. Overall Structure of a Printer

Figure 1:
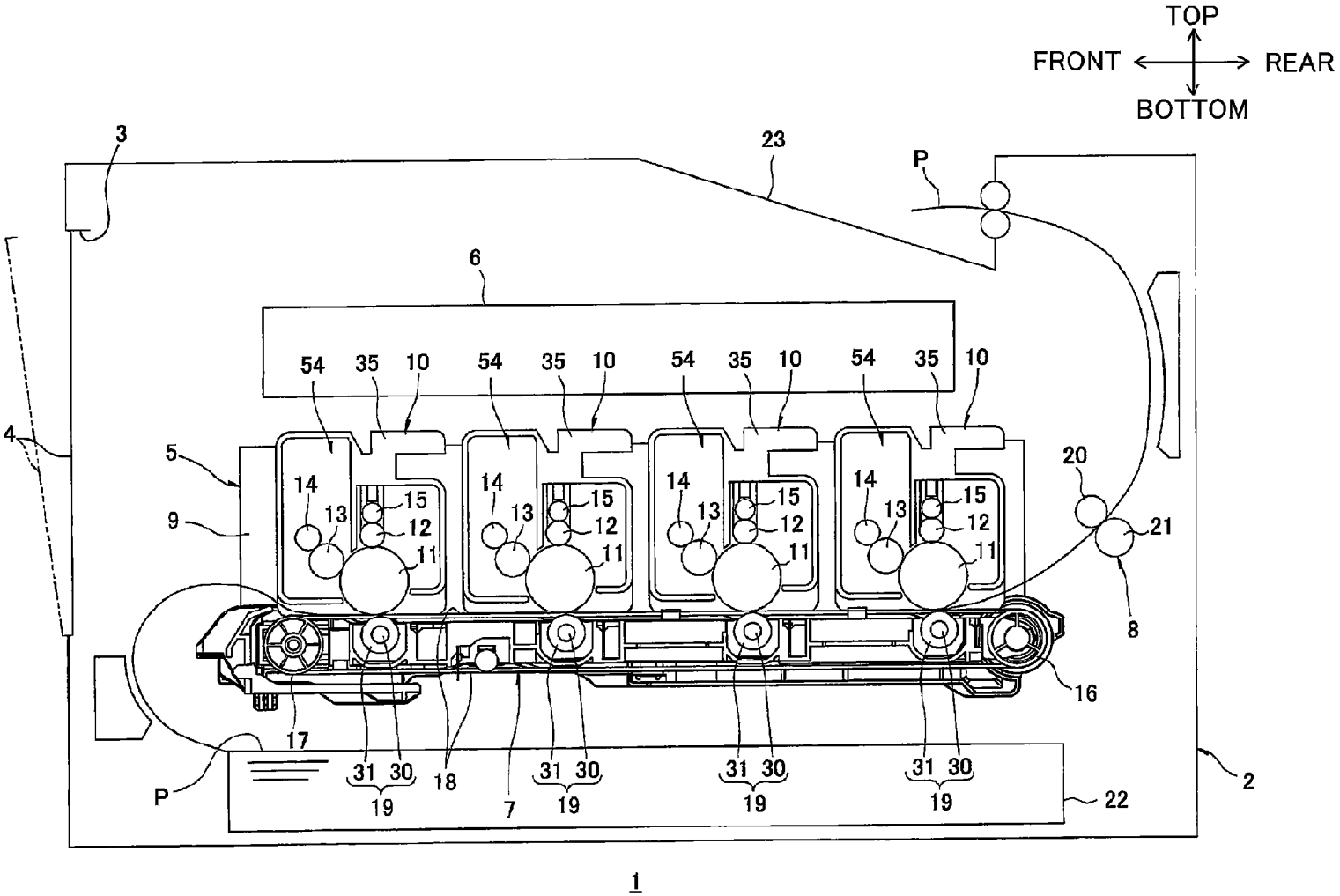
FIG. 1 is a cross-sectional view of an image forming apparatus according an embodiment of the present invention.

A printer 1 shown in FIG. 1 serving as an example of a main body of an image forming apparatus is a horizontal direct tandem-type color laser printer. In the state shown in FIG. 1, the printer 1 is ready for forming images.

Directions in the following description related to the printer 1 will assume that the printer 1 is placed right side up on a level surface. Hence, the upper side of the printer 1 in FIG. 1 will be called the "top," and the lower side will be called the "bottom." Further, the left side of the printer 1 in FIG. 1 will be called the "front," and the right side will be called the "rear." Left and right sides of the printer 1 will be based on the perspective of a user facing the front of the printer 1. Therefore, the far side of the printer 1 in FIG. 1 will be called the "left side," and the near side will be called the "right side."

The printer 1 includes a main casing 2, a front cover 4, a drawer unit 5, a scanning unit 6, a transfer unit 7, and a fixing unit 8. The main casing 2 has a box-like shape and serves as the body of the printer 1. An access opening 3 is formed in the front side of the main casing 2.

The front cover 4 is configured to pivot about its lower edge between a closed position for covering the access opening 3, and an open position for exposing the access opening 3.

The drawer unit 5 can be pulled out of the main casing 2 through the access opening 3. The drawer unit 5 includes a drawer frame 9 having a generally rectangular frame-like structure, and four process cartridges 10 that are retained inside the drawer frame 9 and serving as an example of a cartridge.

The process cartridges 10 are arranged parallel to one another and are spaced at intervals in the front-rear direction. Each of the process cartridges 10 includes a toner-accommodating chamber 54, a photosensitive drum 11, a charging roller 12, a developing roller 13, a supply roller 14, and a cleaning roller 15. The charging roller 12, the developing roller 13, the supply roller 14, or the cleaning roller 15 serves as an example of a process unit. The toner-accommodating chamber 54 constitutes the front section of the process cartridge 10 and is configured to accommodate toner.

The photosensitive drum 11 has a general cylindrical shape that is elongated in the left-right direction (longitudinal direction). The photosensitive drum 11 is rotatably disposed in the bottom of the process cartridge 10 and supported by the cartridge frame 2.

Figures 5A, 5B:
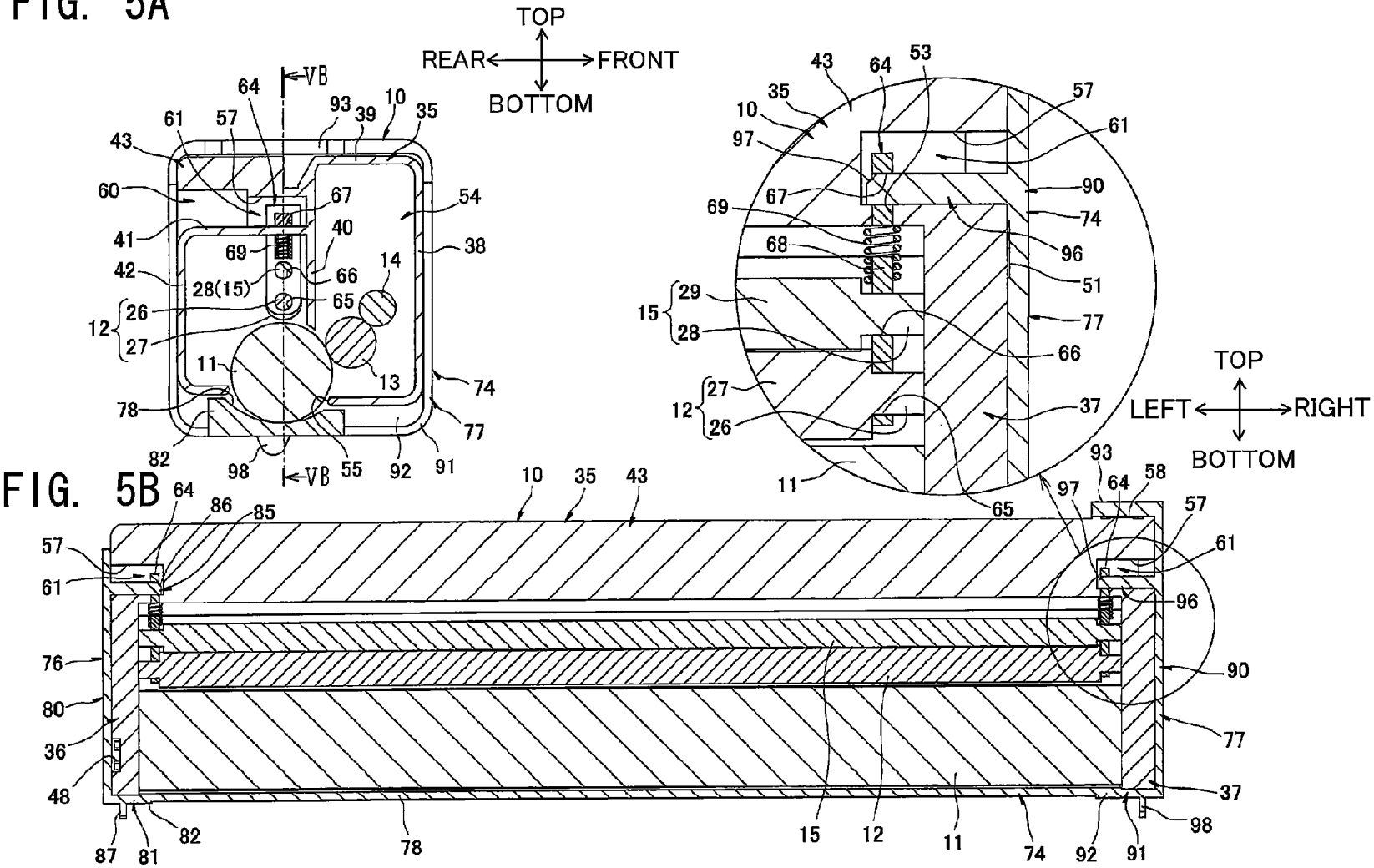
FIG. 5A is a left side cross-sectional view of the cartridge.
FIG. 5B is a cross-sectional view of the cartridge when viewed along line VB-VB of FIG. 5A.

As shown in FIGS. 5A and 5B, each charging roller 12 includes a charging-roller shaft 26, and a charging-roller body 27. The charging-roller shaft 26 has a general columnar shape that is elongated in the left-right direction. The charging-roller body 27 is arranged to cover the charging-roller shaft 26 while leaving both left and right end portions of the charging-roller shaft 26 exposed.

Both left and right ends of the charging-roller shaft 26 are rotatably supported in a pair of respective bearing members 64 described later so that the charging-roller body 27 is in contact with the top peripheral surface of the photosensitive drum 11.

As shown in FIG. 1, the developing roller 13 is disposed inside the corresponding toner-accommodating chamber 54. The developing roller 13 is positioned on the upper front side of the photosensitive drum 11 and contacts the surface of the photosensitive drum 11 on the front side. The developing roller 13 has a general columnar shape that is elongated in the left-right direction.

The supply roller 14 is also disposed in the corresponding toner-accommodating chamber 54 on the upper front side of the developing roller 13 and contacts the surface of the developing roller 13 on the upper front side. The supply roller 14 has a general columnar shape that is elongated in the left-right direction.

As shown in FIG. 5B, the cleaning roller 15 includes a cleaning-roller shaft 28, and a cleaning-roller body 29. The cleaning-roller shaft 28 has a general columnar shape that is elongated in the left-right direction. The cleaning-roller body 29 is arranged to cover the cleaning-roller shaft 28 while leaving both left and right end portions of the cleaning-roller shaft 28 exposed.

Both left and right ends of the cleaning-roller shaft 28 are rotatably supported in a pair of bearing members 64 described later so that the cleaning-roller body 29 of the cleaning roller 15 is in contact with the top surface of the charging roller 12.

Each of the process cartridges 10 is also provided with a thickness-regulating blade (not shown) for regulating the thickness of toner supplied onto the developing roller 13.

As shown in FIG. 1, the scanning unit 6 is disposed in the top section of the main casing 2. The scanning unit 6 irradiates laser beams toward the photosensitive drums 11 based on image data, exposing the photosensitive drums 11 to light.

The transfer unit 7 is disposed in the main casing 2 at a position confronting the bottom of the drawer unit 5. The transfer unit 7 includes a drive roller 16, a follow roller 17, a conveying belt 18 serving as an example of an endless belt, and four transfer rollers 19.

The drive roller 16 is rotatably supported in the rear end of the transfer unit 7. The follow roller 17 is rotatably supported in the front end of the transfer unit 7.

The conveying belt 18 is an endless belt looped around the drive roller 16 and follow roller 17 so that its upper portion contacts the bottom surfaces of all photosensitive drums 11.

When the drive roller 16 is driven to rotate, the conveying belt 18 circulates so that its upper portion moves rearward, while the follow roller 17 follows the circulating motion.

Figure 7:
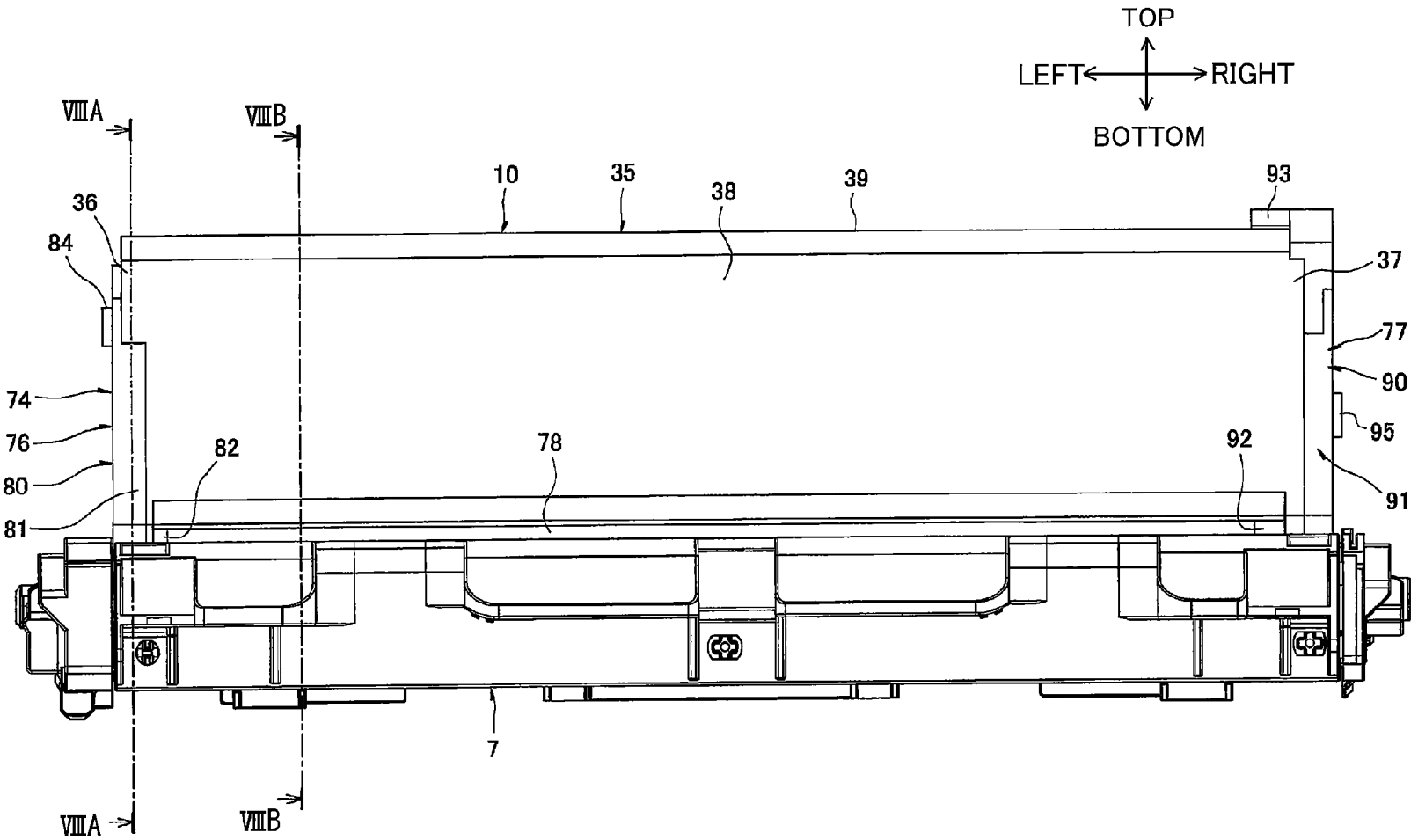
FIG. 7 is a rear view of the cartridge and a transfer unit of the image forming apparatus shown in FIG. 6.
Figure 8A:
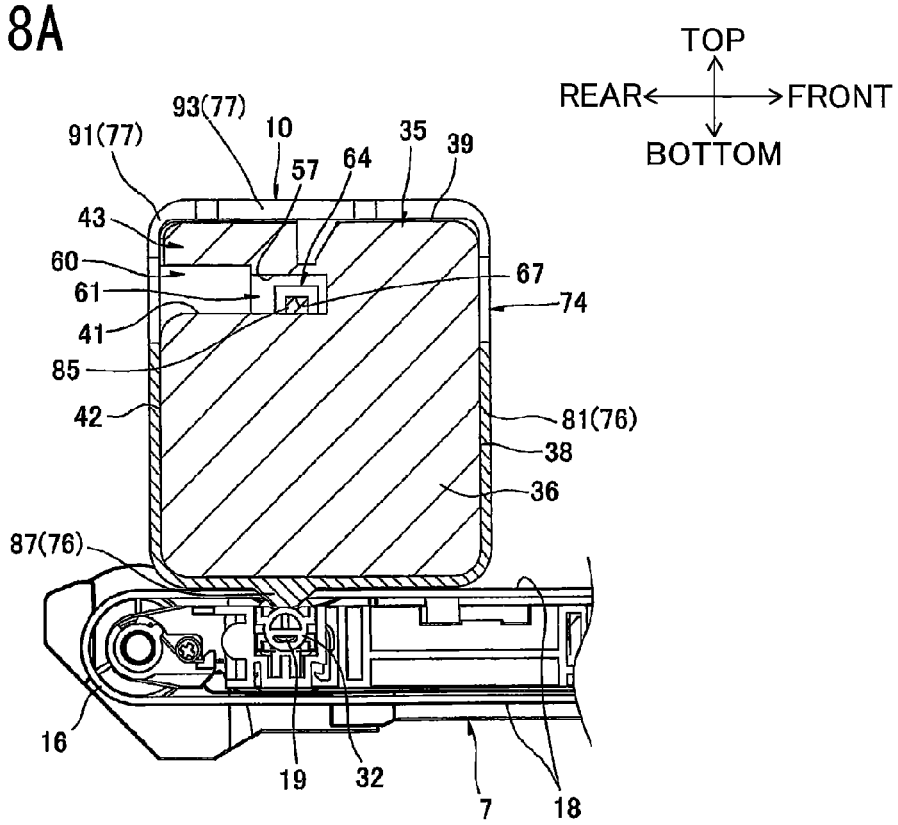
FIG. 8A is a cross-sectional view of the cartridge and the transfer unit when viewed along line VIIIA-VIIIA of FIG. 7.
Figure 8B:
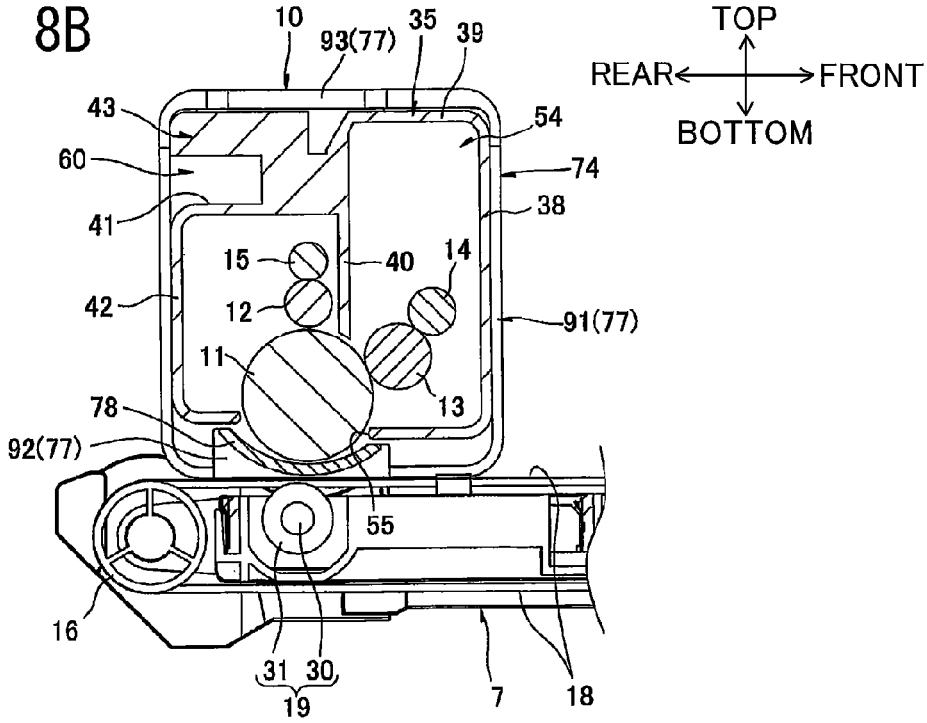
FIG. 8B is a cross-sectional view of the cartridge and the transfer unit when viewed along line VIIIB-VIIIB of FIG. 7.

As shown in FIGS. 7 and 8B, each of the transfer rollers 19 includes a transfer-roller shaft 30, and a transfer-roller body 31. As shown in FIG. 8A, the ends of the transfer roller 19 are supported in a pair of transfer-roller support parts 32.

The transfer-roller shaft 30 has a general columnar shape that is elongated in the left-right direction. The transfer-roller body 31 is arranged to cover the transfer-roller shaft 30 while leaving both left and right end portions of the transfer-roller shaft 30 exposed.

The pairs of transfer-roller support parts 32 are arranged at intervals in the front-rear direction, with one transfer-roller support part 32 of the pair on each of the left and right sides of the transfer unit 7. The transfer-roller support parts 32 have a box shape that is generally rectangular in a side view. A receiving part is formed as a recess in the inner left-right surface of each transfer-roller support part 32 for receiving the corresponding left or right end of the transfer-roller shaft 30. In addition, elastic springs (not shown) constantly urge the transfer-roller support parts 32 upward.

The left and right ends of each transfer-roller shaft 30 are rotatably supported in corresponding transfer-roller support parts 32. The transfer rollers 19 are arranged so that their transfer-roller bodies 31 confront the bottom surfaces of the corresponding photosensitive drums 11, with the upper portion of the conveying belt 18 interposed between the transfer-roller bodies 31 and corresponding photosensitive drums 11.

As shown in FIG. 1, the fixing unit 8 is disposed in confrontation with the rear side of the transfer unit 7. The fixing unit 8 includes a heating roller 20, and a pressure roller 21 confronting the heating roller 20.

The printer 1 initiates an image-forming operation upon receiving an inputted print job. At this time, toner in the toner-accommodating chamber 54 of the process cartridge 10 is positively tribocharged between the supply roller 14 and developing roller 13. The thickness-regulating blade (not shown) regulates the layer of toner carried on the surface of the developing roller 13 at a thin uniform thickness.

In the meantime, the charging roller 12 applies a uniform charge of positive polarity to the peripheral surface of the corresponding photosensitive drum 11. The scanning unit 6 subsequently exposes the surface of the corresponding photosensitive drum 11 with a laser beam based on prescribed image data to form an electrostatic latent image on the surface of the photosensitive drum 11. Next, the toner carried on the developing roller 13 is supplied to the latent image on the surface of the photosensitive drum 11, producing a toner image on the surface of the photosensitive drum 11.

A paper tray 22 is also provided in the bottom section of the main casing 2 for accommodating sheets P of paper. Various rollers convey the sheets P along a U-shaped path that curves first upward and then rearward, and supply the sheets one at a time between the photosensitive drums 11 and the conveying belt 18 at a prescribed timing. The conveying belt 18 conveys each sheet P rearward through positions between the photosensitive drums 11 and their corresponding transfer rollers 19. At this time, a transfer bias is applied to the transfer rollers 19 in order to transfer the toner images from the photosensitive drums 11 onto the sheet P.

Next, as the sheet P passes between the heating roller 20 and pressure roller 21 of the fixing unit 8, the toner images are fixed to the sheet P by heat and pressure. After leaving the fixing unit 8, the sheet P is conveyed along another U-shaped path that curves first upward and then forward, and the sheet P is discharged onto a discharge tray 23 provided on the top surface of the main casing 2.

2. Process Cartridges (1) Cartridge Frame

In addition to the toner-accommodating chamber 54, photosensitive drum 11, charging roller 12, developing roller 13, supply roller 14, cleaning roller 15, and thickness-regulating blade (not shown), each process cartridge 10 includes a cartridge frame 35 serving as an example of a casing, a development coupling 47 (FIG. 2A), a drum coupling 48 serving as an example of a drive receiving portion (FIG. 2A), four electrodes 51 serving as an example of an electrical contacts (FIG. 2B), an IC chip 58 serving as an example of a storage member (FIG. 2A), and a pair of bearing members 64 (FIG. 5A).

As shown in FIG. 1, the cartridge frame 35 is configured to accommodate the photosensitive drum 11, the charging roller 12, the developing roller 13, the supply roller 14, the cleaning roller 15, and the thickness-regulating blade. As shown in FIGS. 2A, 2B, 5A and 5B, the cartridge frame 35 has a box-like shape that is elongated in the left-right direction and opens on the bottom side. The cartridge frame 35 is configured of a left frame wall 36, a right frame wall 37, a front frame wall 38, a front upper frame wall 39, a partitioning frame wall 40 (FIG. 5A), a rear upper frame wall 41, a rear frame wall 42, and a protruding frame wall 43.

The left and right frame walls 36 and 37 are arranged to confront each other while being separated in the left-right direction. The left and right frame walls 36 and 37 both have a plate shape that is generally rectangular in a side view.

Figure 2A:
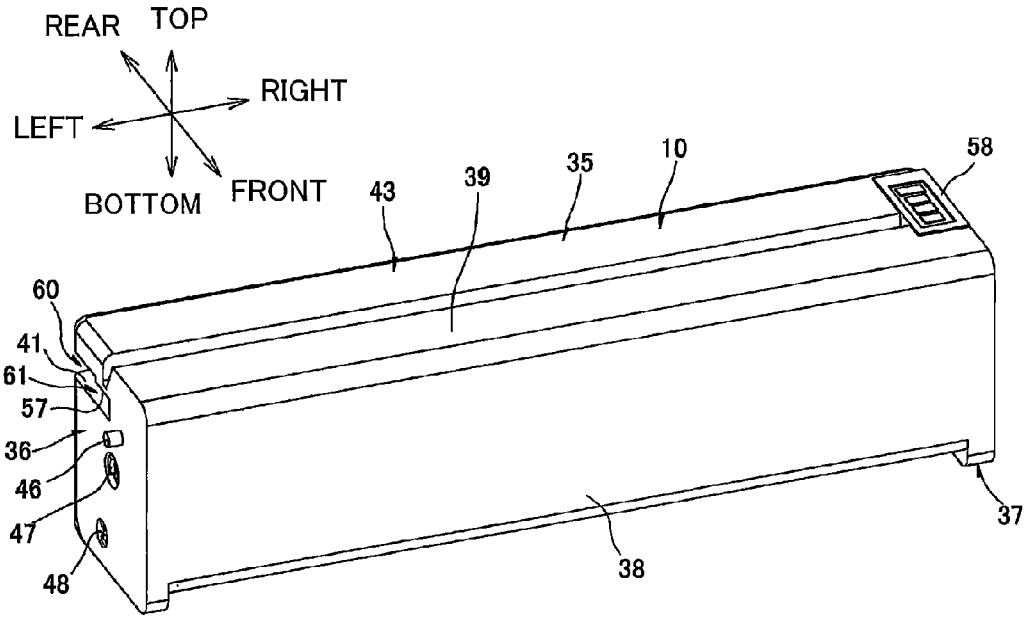
FIG. 2A is a perspective view of a process frame of a cartridge mounted on the image forming device when viewed from front and left.

As shown in FIG. 2A, the left frame wall 36 includes a left positioning protrusion 46. The left positioning protrusion 46 has a substantial columnar shape and protrudes leftward from the left surface of the left frame wall 36 at the upper front portion thereof.

The right frame wall 37 includes a right positioning protrusion 50. The right positioning protrusion 50 has a general cylindrical shape and protrudes rightward from the right surface of the right frame wall 37 in the approximate center thereof.

Figure 2B:
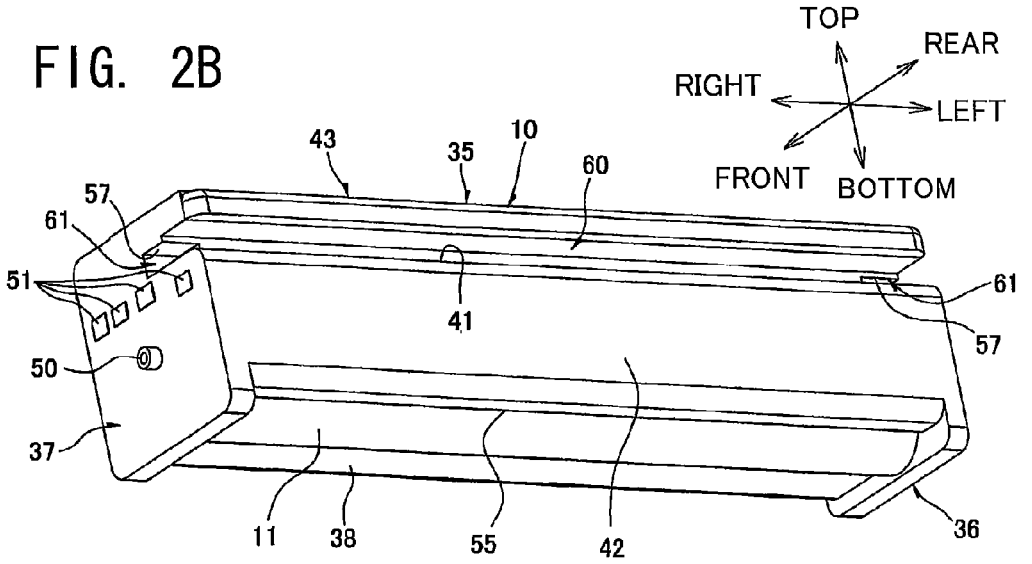
FIG. 2B is a perspective view of the process frame when viewed from rear and right.

As shown in FIGS. 2A, 2B and 5A, the front frame wall 38 has a generally flat plate shape that is elongated in the left-right direction and bridges the front edges of the left and right frame walls 36 and 37. The bottom edge of the front frame wall 38 curves rearward at a position higher than the bottom edges of the left and right frame walls 36 and 37.

The front upper frame wall 39 extends continuously rearward from the top edge of the front frame wall 38. The front upper frame wall 39 has a generally flat plate shape that is elongated in the left-right direction and bridges the top edges of the left and right frame walls 36 and 37 in the front portions thereof.

As shown in FIG. 5A, the partitioning frame wall 40 extends continuously downward from the rear edge of the front upper frame wall 39. The partitioning frame wall 40 has a generally flat plate shape that is elongated in the left-right direction and bridges the approximate front-rear center portions of the left and right frame walls 36 and 37. The bottom edge of the partitioning frame wall 40 extends to a position for opposing the upper front surface of the photosensitive drum 11.

The rear upper frame wall 41 extends continuously rearward from the rear surface of the partitioning frame wall 40 in the approximate vertical center region thereof. The rear upper frame wall 41 has a generally flat plate shape that is elongated in the left-right direction and bridges the left and right frame walls 36 and 37 at a position approximately one-third down from the tops of the same. As shown in FIG. 5B, the rear upper frame wall 41 includes a pair of communication holes 53.

The communication holes 53 are generally rectangular in a plan view and penetrate the rear upper frame wall 41 at positions near both left and right ends thereof. The communication holes 53 provide communication between the interior and exterior of the cartridge frame 35.

As shown in FIGS. 2B and 5A, the rear frame wall 42 extends continuously downward from the rear edge of the rear upper frame wall 41. The rear frame wall 42 has a generally flat plate shape that is elongated in the left-right direction and bridges the rear edges of the left and right frame walls 36 and 37. The bottom edge of the rear frame wall 42 curves forward at a position higher than the bottom edges of the left and right frame walls 36 and 37.

Here, a space defined by the left frame wall 36, the right frame wall 37, the partitioning frame wall 40, the front frame wall 38, and front upper frame wall 39 will be called the toner-accommodating chamber 54. Further, the opening formed between the rearward curved bottom edge of the front frame wall 38 and the forward curved bottom edge of the rear frame wall 42 will be defined as an exposure opening 55. As shown in FIGS. 2B and 5A, the bottom surface of the photosensitive drum 11 is exposed through the exposure opening 55.

As shown in FIGS. 2A, 2B, and 5A, the protruding frame wall 43 first extends rearward from a portion of the partitioning frame wall 40 above the portion with which the rear upper frame wall 41 is continuously formed, in a direction parallel to the top surface of the rear upper frame wall 41, bends and extends upward from a position above the approximate front-rear center region of the rear upper frame wall 41, and again extends rearward, forming a general crank shape in a side view. The top surface of the protruding frame wall 43 is flush with the top surface of the front upper frame wall 39. The protruding frame wall 43 also includes recessed parts 57.

The recessed parts 57 are generally rectangular-shaped depressions that extend forward from the lower rear end face of the protruding frame wall 43 on both left and right outer ends thereof. The recessed parts 57 expose the communication holes 53 formed in the rear upper frame wall 41.

As shown in FIG. 2A, the development coupling 47 is provided in the approximate center of the left frame wall 36 when viewed from the side and at a position to the lower rear of the left positioning protrusion 46. The development coupling 47 is connected to the charging roller 12, the developing roller 13, the supply roller 14, and the cleaning roller 15 through various gears (not shown). The development coupling 47 is configured to transmit a drive force from a drive source (not shown) provided in the main casing 2 to the charging roller 12, the developing roller 13, the supply roller 14, and the cleaning roller 15.

The drum coupling 48 is provided in the lower rear portion of the left frame wall 36 to the lower rear of the development coupling 47. Though not shown in the drawings, the drum coupling 48 is connected to a gear on the photosensitive drum 11 and is configured to transmit a drive force to the photosensitive drum 11 from a drive source (not shown) provided in the main casing 2.

As shown in FIG. 2B, the electrodes 51 are arranged at intervals in the front-rear direction above the right positioning protrusion 50 and are exposed to the outside of the right frame wall 37. The electrodes 51 are electrically connected to the charging roller 12, developing roller 13, supply roller 14, and cleaning roller 15, respectively, and supply electrical power to the same from a power supply (not shown) provided in the main casing 2.

As shown in FIGS. 2B and 5B, the IC chip 58 is disposed on the right end portion of the protruding frame wall 43. The front end of the IC chip 58 extends to the rear edge of the front upper frame wall 39 at the right end thereof. The IC chip 58 can be electrically connected to a reading unit (not shown) provided in the main casing 2. As an example, the IC chip 58 may be configured of a storage medium that stores information related to the number of pages printed, the time for replacement of the process cartridge 10, color information for the process cartridge 10, and other data related to the cartridge frame 35.

Here, as shown in FIGS. 2A, 2B, 5A and 5B, the space bounded by the protruding frame wall 43 and rear upper frame wall 41 will be defined as a space 60, while the spaces bounded by each of the recessed parts 57 formed in the protruding frame wall 43 and the rear upper frame wall 41 will be defined as fitting grooves 61. The left frame wall 36 is formed with a groove that overlaps the space 60 and the fitting grooves 61 in a left to right projection and that penetrates through the left frame wall 36 in the left and right directions. Similarly, the right frame wall 37 is formed with a groove that overlaps the space 60 and the fitting grooves 61 in the left to right projection and that penetrates through the right frame wall 37 in the left and right directions. In other words, each of the grooves formed on the left frame wall 36 and the right frame wall 37 has the same cross-sectional shape as that of the combination of the space 60 and the fitting grooves 61.

As shown in FIGS. 5A and 5B, the bearing members 64 have a flat plate shape that is generally rectangular in a side view and elongated vertically. The bearing members 64 are inserted through the corresponding communication holes 53 formed in the rear upper frame wall 41. Each bearing member 64 includes a charging-roller-shaft support part 65, a cleaning-roller-shaft support part 66, an elastic-spring receiving part 67, an elastic-spring insertion shaft 68, and an elastic spring 69.

The charging-roller-shaft support part 65 is formed with a hole having a general circular shape in a side view and penetrating the lower end of the bearing member 64. The charging-roller-shaft support part 65 receives the charging-roller shaft 26 of the charging roller 12.

The cleaning-roller-shaft support part 66 is formed with a hole having a general circular shape in a side view and penetrating the approximate vertical center region of the bearing member 64. The cleaning-roller-shaft support part 66 accepts the cleaning-roller shaft 28 of the cleaning roller 15.

The elastic-spring receiving part 67 is formed with a through hole having a general rectangular shape in a side view and penetrating the upper portion of the bearing member 64.

The elastic-spring insertion shaft 68 has a general circular columnar shape and protrudes upward from the inner bottom surface of the elastic-spring receiving part 67.

The elastic spring 69 has a helical shape that expands vertically. The outer diameter of the elastic spring 69 is greater than the left-right dimension of the communication holes 53 formed in the rear upper frame wall 41. The elastic spring 69 is accommodated in the elastic-spring receiving part 67 by placing the elastic spring 69 over the elastic-spring insertion shaft 68 such that the bottom end of the elastic spring 69 contacts the inner bottom surface of the elastic-spring receiving part 67, and the upper end of the elastic spring 69 contacts the bottom surface of the rear upper frame wall 41.

With this construction, the charging roller 12 and cleaning roller 15 are supported in the bearing members 64 so as to contact each other. The elastic spring 69 urges the cleaning roller 15 and charging roller 12 downward so that the charging roller 12 contacts the top surface of the photosensitive drum 11.

(2) Cartridge Cover

Figure 6:
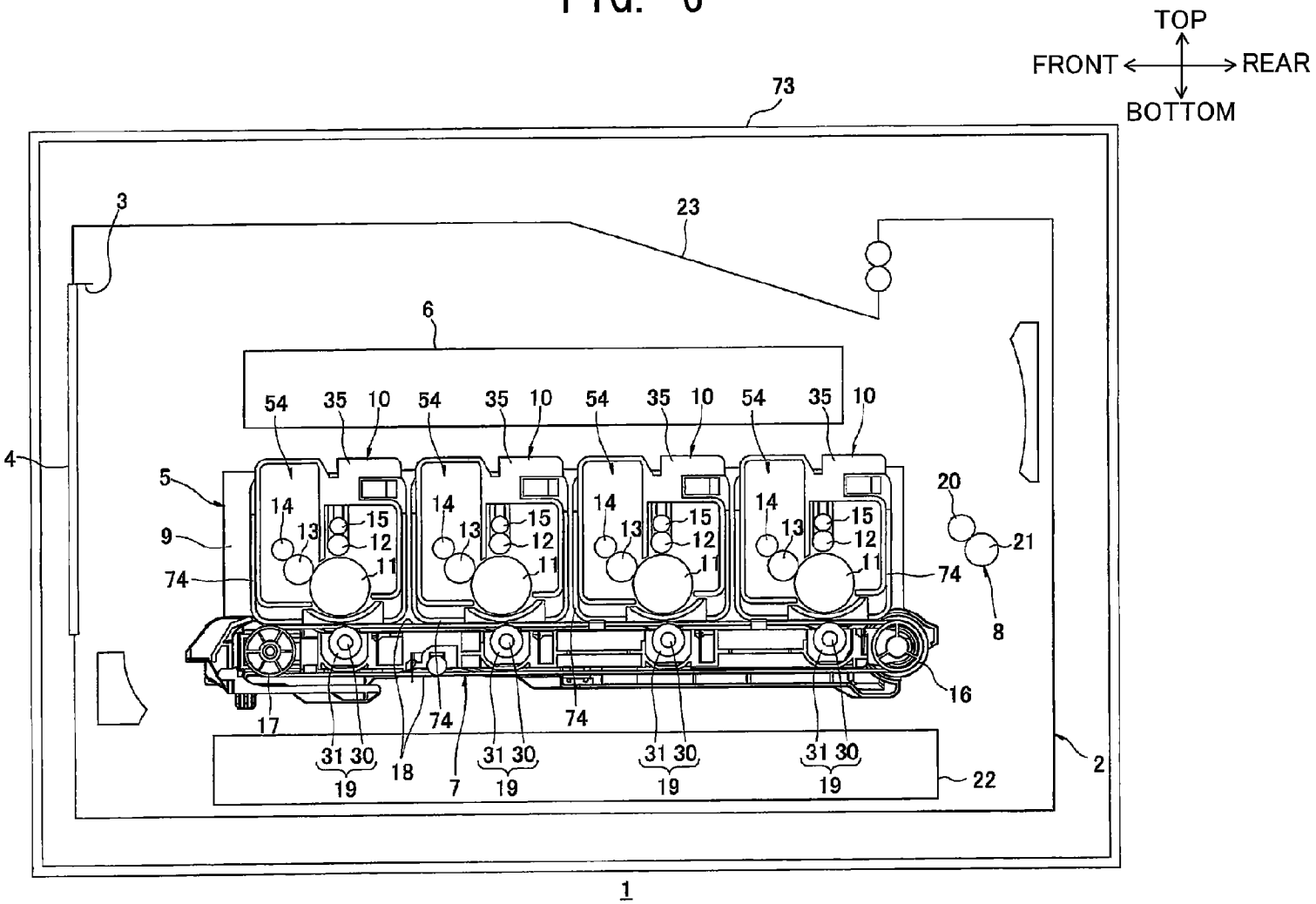
FIG. 6 is a cross-sectional view of the image forming apparatus in which the cartridge is mounted when the image forming apparatus is shipped and transported.

In addition to the cartridge frame 35 described above, the process cartridge 10 also includes a cartridge cover 74 serving as an example of a separating member or cover used for shipping and transport. As shown in FIG. 6, the main casing 2 is packaged in a packing member 73 when the printer 1 is shipped and transported.

The packing member 73 has a box-like shape that is larger than the main casing 2. The packing member 73 is formed of cardboard or another type of heavy paper. When packaging the printer 1 in the packing member 73, each of the process cartridges 10 is mounted in and attached to the main casing 2 with the cartridge cover 74 mounted on the corresponding cartridge frame 35.

Figure 3A:
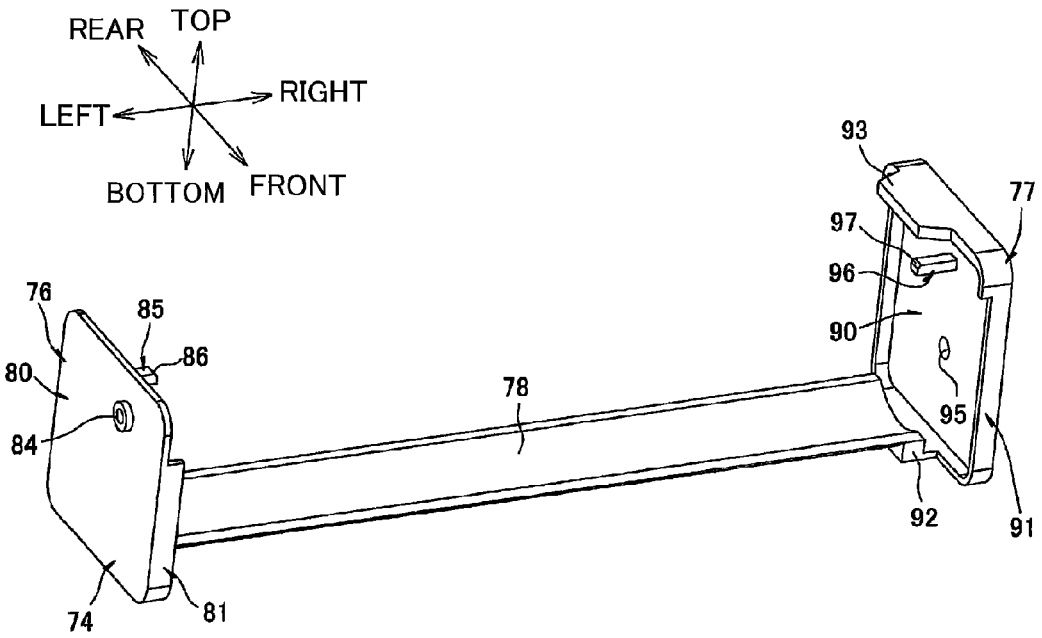
FIG. 3A is a perspective view of a process cover attached to the process frame when viewed from front and left.
Figure 3B:
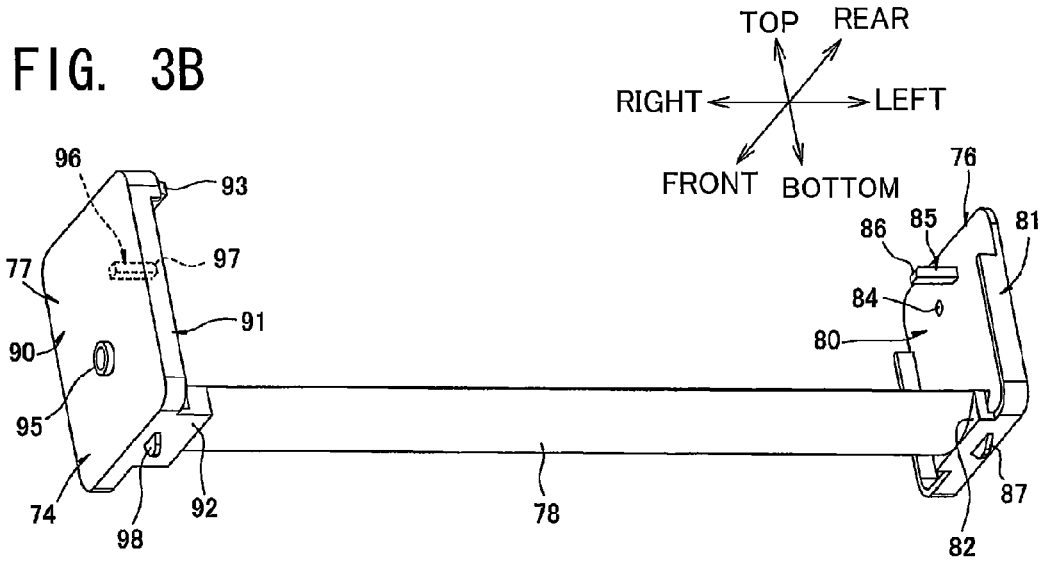
FIG. 3B is a perspective view of the process cover when viewed from rear and right.

The cartridge cover 74 is formed of a resin material such as polypropylene, or another type of polymer. As shown in FIGS. 3A and 3B, the cartridge cover 74 is integrally provided with a left cover wall 76 serving as an example of a first end portion or a first plate portion, a right cover wall 77 serving as an example of a second end portion or a second plate portion, and a linking part 78 serving as an example of a connecting portion or a cover portion.

The left cover wall 76 and right cover wall 77 are arranged apart from each other in the left-right direction and are parallel. The left cover wall 76 is configured of a left body part 80 serving as an example of a protecting portion, a left engaging frame 81, and a left connecting part 82.

The left body part 80 has a flat plate shape that is generally rectangular in a side view. The vertical and left-right dimensions of the left body part 80 are slightly larger than those of the left frame wall 36 constituting the cartridge frame 35. The left body part 80 includes a left positioning part 84, and a left fitting protrusion 85 serving as an example of an extending portion.

The left positioning part 84 has a general cylindrical shape and protrudes leftward from the left surface of the left body part 80 in the upper front portion thereof. A hole having a general circular shape in a side view penetrates the left body part 80 in an area corresponding to the inner diameter of the left positioning part 84. The inner diameter of the left positioning part 84 is slightly larger than the outer diameter of the left positioning protrusion 46 constituting the cartridge frame 35.

The left fitting protrusion 85 has a rail-like shape and extends and protrudes rightward from the right surface of the left body part 80, and specifically at a position in the upper portion of the left body part 80 that is approximately centered in the front-rear direction. The left fitting protrusion 85 includes a left chamfered part 86.

The left chamfered part 86 is a sloped surface in the top surface of the left fitting protrusion 85 at the upper right corner thereof that slopes downward toward the right.

The left engaging frame 81 is provided along the peripheral edge on the right surface of the left body part 80 and, more specifically, protrudes rightward from the bottom edge of the left body part 80, a lower portion on the front edge of the left body part 80, and a lower portion on the rear edge of the left body part 80. The inner surface of the left engaging frame 81 conforms to the outer shape of the left frame wall 36 constituting the cartridge frame 35. The left engaging frame 81 includes a left transfer-roller pressing part 87 serving as an example of a first protruding portion or a protrusion (FIG. 3B).

The left transfer-roller pressing part 87 has a plate shape that is generally semicircular in a side view. The left transfer-roller pressing part 87 protrudes downward from the bottom surface of the left engaging frame 81 at the approximate front-rear center thereof.

The left connecting part 82 has a plate shape that is generally L-shaped in a front view. Specifically, the left connecting part 82 extends continuously rightward from the right edge of the lower portion of the left engaging frame 81 at approximately the front-rear center region thereof, then bends and extends upward. The top edge of the left connecting part 82 is depressed downward so as to have a general arc-shape in a side view that conforms to the peripheral surface of the photosensitive drum 11.

As shown in FIGS. 3A and 3B, the right cover wall 77 is configured of a right body part 90 serving as an example of an electrical contact protecting portion, a right engaging frame 91, a right connecting part 92, and an IC chip protecting part 93 serving as an example of a storage member protecting portion.

The right body part 90 has a flat plate shape that is generally rectangular in a side view. The vertical and left-right dimensions of the right body part 90 are slightly greater than those of the right frame wall 37 constituting the cartridge frame 35. The right body part 90 is provided with a right positioning part 95, and a right fitting protrusion 96 serving as an example of an extending portion.

The right positioning part 95 has a general cylindrical shape that protrudes rightward from the right surface of the right body part 90 at the approximate front-rear center region thereof. A hole having a general circular shape in a side view penetrates the right body part 90 in a position aligned with the inner diameter of the right positioning part 95. The inner diameter of the right positioning part 95 is slightly larger than the outer diameter of the right positioning protrusion 50 provided on the cartridge frame 35.

The right fitting protrusion 96 has a rail-like shape and protrudes leftward from a position in the upper portion of the right body part 90 that is approximately centered in the front-rear direction, and specifically a position aligned with the left fitting protrusion 85 of the left cover wall 76 in the left-right direction. The right fitting protrusion 96 includes a right chamfered part 97.

The right chamfered part 97 is a sloped surface formed in the top surface of the right fitting protrusion 96 at the upper left end thereof. The right chamfered part 97 slopes downward toward the left side.

The right engaging frame 91 protrudes leftward from the entire peripheral edge on the left surface of the right body part 90. The inner surface of the right engaging frame 91 conforms to the outer shape of the right frame wall 37 constituting the cartridge frame 35. The right engaging frame 91 includes a right transfer-roller pressing part 98 serving as an example of a second protruding portion or a protrusion.

The right transfer-roller pressing part 98 has a plate shape that has a general semicircular shape in a side view. The right transfer-roller pressing part 98 protrudes downward from the bottom surface of the right engaging frame 91 in the approximate front-rear center portion thereof.

The right connecting part 92 has a plate shape that is generally L-shaped in a front view. Specifically, the right connecting part 92 extends continuously leftward from the left edge on the lower portion of the right engaging frame 91 at the approximate front-rear center thereof, then bends and extends upward. The top edge of the right connecting part 92 is depressed to form a general arc-shape in a side view that conforms to the peripheral surface of the photosensitive drum 11.

The IC chip protecting part 93 has a plate shape that is generally rectangular in a plan view. The IC chip protecting part 93 protrudes leftward from the left surface of the right engaging frame 91 at the upper portion thereof. The front-rear dimension of the IC chip protecting part 93 is slightly larger than that of the IC chip 58. The sum of the left-right dimension of the IC chip protecting part 93 and the left-right dimension of the right engaging frame 91 is slightly greater than the left-right dimension of the IC chip 58.

The linking part 78 links the left connecting part 82 of the left cover wall 76 to the right connecting part 92 of the right cover wall 77. The linking part 78 has a plate shape that is generally arc-shaped in a side view such that the top surface of the linking part 78 conforms to the peripheral surface of the photosensitive drum 11.

(3) Mounting the Cartridge Cover on the Cartridge Frame

Next, the operations for mounting the cartridge cover 74 on the cartridge frame 35 will be described with reference to FIGS. 4A and 4B.

Here, the upper portions of the left and right cover walls 76 and 77 constituting the cartridge cover 74 can be flexed outward in the respective left and right directions in order to mount the cartridge cover 74 on the cartridge frame 35. Thus, in a front view, the left cover wall 76 is bent in a counterclockwise direction about the left connecting part 82, and the right cover wall 77 is bent in a clockwise direction about the right connecting part 92.

Next, the cartridge cover 74 is brought near the cartridge frame 35 so that the linking part 78 approaches the photosensitive drum 11. At this time, the bottom edge of the left frame wall 36 is disposed on the inner surface of the left engaging frame 81 on the left cover wall 76 before the linking part 78 is positioned to protect the photosensitive drum 11, and the bottom edge of the right frame wall 37 is subsequently disposed on the inner surface of the right engaging frame 91 constituting the right cover wall 77. Through this operation, the linking part 78 of the cartridge cover 74 is positioned relative to the cartridge frame 35. Hence, the cartridge cover 74 can be attached to the cartridge frame 35 without damaging the photosensitive drum 11.

Next, the upper portions of the left and right cover walls 76 and 77 are allowed to return to their natural state by canceling the force used to flex these upper portions outward in the corresponding left and right directions. As a result, the left positioning protrusion 46 on the left frame wall 36 is inserted through the left positioning part 84 formed in the left cover wall 76, and the right positioning protrusion 50 formed on the right frame wall 37 is inserted through the right positioning part 95 formed in the right cover wall 77.

These insertions position the left and right frame walls 36 and 37 of the cartridge cover 74 relative to the process cartridge 10. At this time, the left fitting protrusion 85 of the left cover wall 76 and the right fitting protrusion 96 of the right cover wall 77 are positioned inside the fitting grooves 61 of the cartridge frame 35.

As shown in FIG. 5B, the left fitting protrusion 85 and right fitting protrusion 96 are inserted into the upper portions of the elastic-spring receiving parts 67 formed in the corresponding bearing members 64. More specifically, when the left fitting protrusion 85 and right fitting protrusion 96 are inserted into the upper portions of the elastic-spring receiving parts 67, first the left chamfered part 86 of the left fitting protrusion 85 and the right chamfered part 97 of the right fitting protrusion 96 contact the top surfaces of the elastic-spring receiving parts 67. Consequently, the bearing members 64 move upward together with the charging roller 12 and cleaning roller 15 supported in the bearing members 64 along the sloped surfaces of the left chamfered part 86 and right chamfered part 97 and against the urging force of the elastic springs 69. This action separates the charging roller 12 from the photosensitive drum 11.

Further, since the left cover wall 76 covers the entire left surface of the left frame wall 36, the development coupling 47 and drum coupling 48 are covered by the left body part 80. In this way, the development coupling 47 and drum coupling 48 are protected.

Further, since the right cover wall 77 covers the entire right surface of the right frame wall 37, the electrodes 51 are covered by the right body part 90. In this way, the electrodes 51 are protected.

Further, since the IC chip protecting part 93 of the right cover wall 77 slides leftward over the top surface of the right frame wall 37 to a position for covering portions of the top surfaces of the front upper frame wall 39 and protruding frame wall 43, the IC chip 58 is covered by the IC chip protecting part 93. In this way, the IC chip 58 is also protected.

3. Shipping and Transport of the Process Cartridges.

As shown in FIG. 6, the process cartridges 10 are accommodated in the main casing 2 when the printer 1 is shipped and transported. At this time, the cartridge covers 74 described above are attached to the cartridge frames 35 of the process cartridges 10.

When the process cartridges 10 are accommodated in the main casing 2 with the attached cartridge covers 74, the left transfer-roller pressing part 87 of the left cover wall 76 and the right transfer-roller pressing part 98 of the right cover wall 77 in each cartridge cover 74 press down on the tops of the corresponding transfer-roller support parts 32 in the transfer unit 7 as shown in FIG. 8A. As a result, the transfer-roller support parts 32 are moved downward relative to the main casing 2 against the urging force of the elastic springs (not shown). At the same time, the transfer rollers 19 move downward together with the transfer-roller support parts 32, thereby alleviating the upward force that the transfer rollers 19 apply to the conveying belt 18.

In this way, the cartridge covers 74 cover and protect the surfaces of the corresponding photosensitive drums 11 that are exposed through the exposure openings 55 formed in the cartridge frames 35 and keep the photosensitive drums 11 separated from the conveying belt 18.

When the user subsequently wishes to use the printer 1, the user pulls the drawer frame 9 out of the main casing 2 and removes the process cartridges 10 from the drawer frame 9. Next, the user detaches the cartridge covers 74 from the process cartridges 10, remounts the process cartridges 10 in the drawer frame 9, and pushes the drawer frame 9 back into the main casing 2. This completes the operations for mounting the process cartridges 10 in the main casing 2.

4. Operational Advantages (1) According to the printer 1 and process cartridges 10 of the embodiment described above, the main casing 2 is packaged in the packing member 73 while the process cartridges 10 are mounted inside the main casing 2. At this time, the cartridge covers 74 keep the photosensitive drums 11 separated from the conveying belt 18 provided in the main casing 2, as illustrated in FIGS. 6, 8A and 8B. Further, the linking part 78 of each cartridge cover 74 that links the left cover wall 76 to the right cover wall 77 serves to protect the corresponding photosensitive drum 11.

Thus, even when the printer 1 incurs vibrations and impacts while packaged with the process cartridges 10 mounted in the main casing 2, the above construction can restrain the photosensitive drums 11 from contacting the conveying belt 18 and can restrain foreign matter from becoming deposited on the surfaces of the photosensitive drums 11. Thus, the configuration of the embodiment can preserve the quality of the photosensitive drums 11.

Figure 4A:
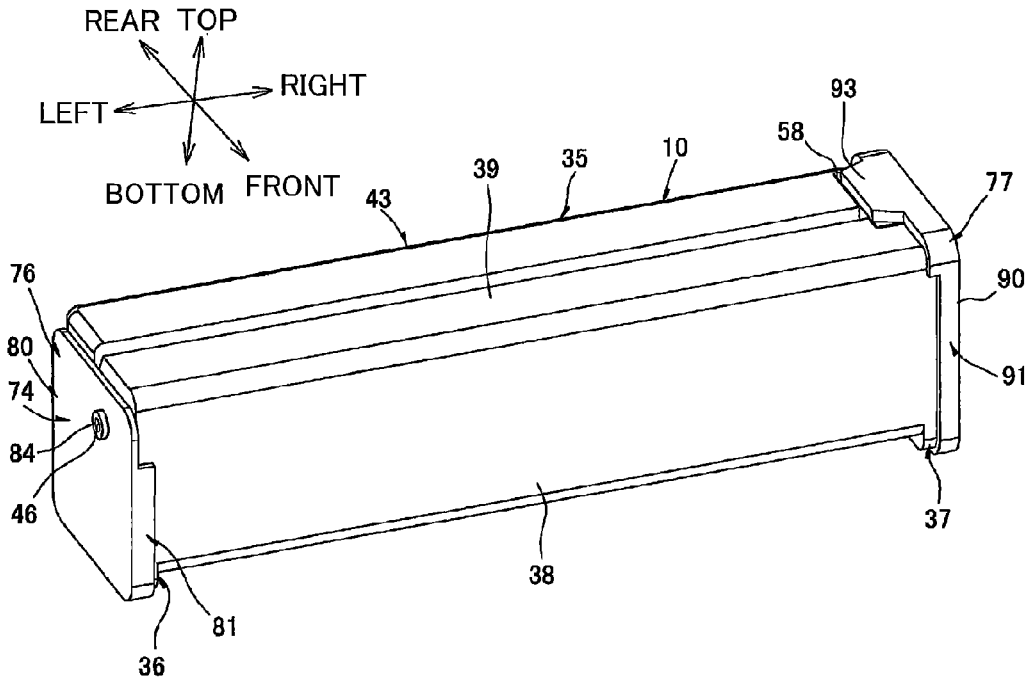
FIG. 4A is a perspective view of the cartridge including the process cover attached to the process frame when viewed from front and left.
Figure 4B:
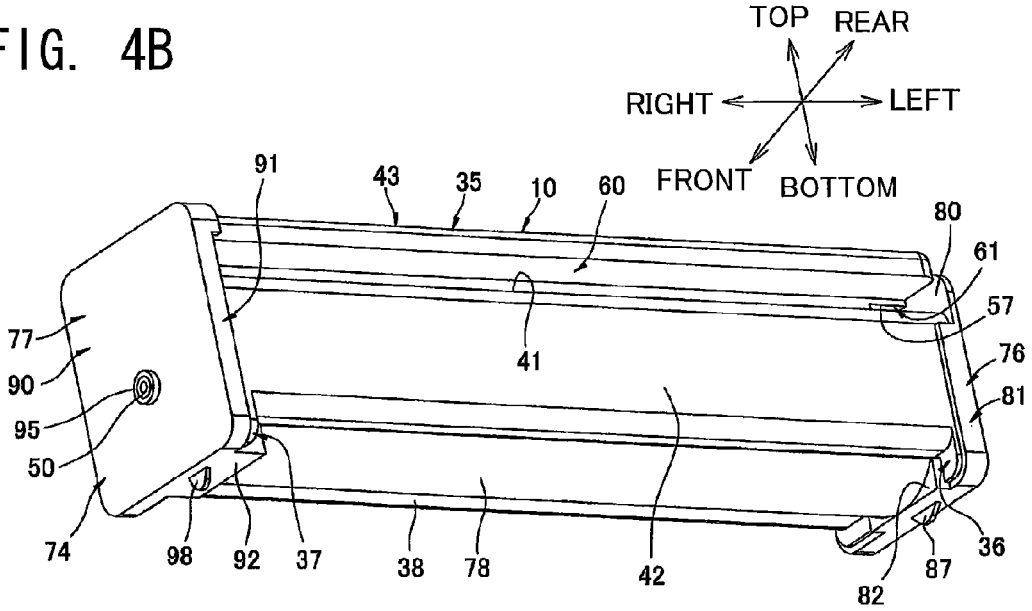
FIG. 4B is a perspective view of the cartridge including the process cover attached to the process frame when viewed from rear and right.

(2) As shown in FIGS. 4A and 4B, the left body part 80 of the left cover wall 76 constituting the cartridge cover 74 covers and protects the drum coupling 48 formed in the corresponding process cartridge 10. Hence, the cartridge cover 74 preserves the quality of the process cartridge 10 by protecting the drum coupling 48.

(3) As shown in FIGS. 4A and 4B, the right body part 90 of the right cover wall 77 constituting the cartridge cover 74 covers and protects the electrodes 51. Hence, the cartridge cover 74 can preserve the quality of the process cartridge 10 by protecting the electrodes 51.

(4) As shown in FIGS. 4A and 4B, the IC chip protecting part 93 provided on the right cover wall 77 of the cartridge cover 74 covers and protects the IC chip 58. Hence, the cartridge cover 74 can preserve the quality of the process cartridge 10 by protecting the IC chip 58.

(5) As shown in FIGS. 4A and 4B, the cartridge cover 74 is positioned relative to the cartridge frame 35 by inserting the left positioning protrusion 46 of the cartridge frame 35 into the left positioning part 84 and by inserting the right positioning protrusion 50 into the right positioning part 95. This configuration enables the cartridge cover 74 to reliably protect the photosensitive drum 11 and to preserve the quality of the same. The left positioning protrusion 46, the left positioning part 84, the right positioning protrusion 50, and the right positioning part 95 serve as an example of a positioning portion.

(6) As shown in FIGS. 8A and 8B, the left transfer-roller pressing part 87 and right transfer-roller pressing part 98 of the cartridge cover 74 press downward on the transfer-roller support parts 32 supporting the left and right ends of the transfer-roller shaft 30, thereby reliably separating the transfer roller 19 from the photosensitive drum 11. Consequently, the conveying belt 18 interposed between the photosensitive drums 11 and corresponding transfer rollers 19 is not pressed against the photosensitive drums 11.

As a result, the left transfer-roller pressing part 87 and right transfer-roller pressing part 98 of each cartridge cover 74 can keep the conveying belt 18 separated from the photosensitive drums 11, thereby preventing the conveying belt 18 and photosensitive drums 11 from coming into contact through the linking parts 78 that cover the photosensitive drums 11.

(7) As shown in FIG. 5B, each charging roller 12 can be separated from the corresponding photosensitive drum 11 by inserting the left fitting protrusion 85 and right fitting protrusion 96 into the elastic-spring receiving parts 67 of the bearing members 64 and causing the charging roller 12 supported in the bearing members 64 to move upward. Hence, when the main casing 2 is packaged with the process cartridges 10 mounted inside the main casing 2, the left fitting protrusion 85 and right fitting protrusion 96 can prevent the charging roller 12 from contacting the corresponding photosensitive drum 11. Thus, this construction can preserve the quality of the photosensitive drums 11 and charging rollers 12.

(8) As shown in FIGS. 3A and 3B, the cartridge cover 74 can easily be formed of a resin material.

What is claimed is:

1. An image forming apparatus comprising:

a main body;

an endless belt, the endless belt extending around a first roller and a second roller;

a cartridge attachable to the main body and comprising:

a casing extending in a longitudinal direction and having one end wall and another end wall opposite to the one end wall in the longitudinal direction;

a photosensitive drum supported by the casing and extending in the longitudinal direction such that a peripheral surface of the photosensitive drum is positioned in confrontation with the endless belt when the cartridge is attached to the main body;

a drum coupling provided on the one end wall; and a development coupling provided on the one end wall, the development coupling being different from the drum coupling;

a transfer roller extending in the longitudinal direction such that the endless belt is interposed between the transfer roller and the peripheral surface of the photosensitive drum when the cartridge is attached to the main body, the transfer roller including a transfer roller shaft and a transfer roller body formed around the transfer roller shaft;

a support part having a recess that rotatably supports the transfer roller shaft, the support part being urged by spring force upwardly such that a peripheral surface of the transfer roller body is pressed against the endless belt; and a separating member attachable to the casing of the cartridge and comprising a first end portion, a second end portion, and a connecting portion disposed between the first end portion and the second end portion, wherein:

the first end portion, the second end portion, and the connecting portion are integrally formed;

the first end portion includes a first pressing part, and a first protecting portion that covers the drum coupling when the separating member is attached to the casing of the cartridge;

the second end portion includes a second pressing part;

the first protecting portion covers the development coupling when the separating member is attached to the casing of the cartridge;

when the separating member is attached to the casing of the cartridge, the first end portion is disposed on the one end wall of the casing, the second end portion is disposed on the another end wall of the casing, and the connecting portion is disposed in confrontation with the peripheral surface of the photosensitive drum; and when the cartridge having the separating member attached is attached to the main body, the first pressing part and the second pressing part contact and press the support part, thereby moving the support part and the transfer roller shaft against the spring force such that the endless belt is not pressed against and is separated from the peripheral surface of the transfer roller body, and the connecting portion is disposed between the peripheral surface of the photosensitive drum and the endless belt.

2. The image forming apparatus according to claim 1, wherein each of a length of the first pressing part and a length of the second pressing part is substantially identical to a distance between the endless belt and the peripheral surface of the transfer roller body while the endless belt is separated from the peripheral surface of the transfer roller body.

3. The image forming apparatus according to claim 1, wherein:

the cartridge further comprises an electrical contact provided on the another end wall; and the second end portion further includes a second protecting portion that covers the electrical contact when the separating member is attached to the casing of the cartridge.

4. The image forming apparatus according to claim 3, wherein:

the cartridge further comprises an IC chip provided on the casing; and the second end portion further includes a third protecting portion that covers the IC chip when the separating member is attached to the casing of the cartridge.

5. The image forming apparatus according to claim 3, wherein:

the cartridge further comprises a developing roller; and the electrical contact is electrically connected to the developing roller.

6. The image forming apparatus according to claim 1, wherein:

the cartridge further comprises:

a charging roller extending in the longitudinal direction, the charging roller including a charging roller shaft and a charging roller body formed around the charging roller shaft;

a first bearing member movably supported by the casing, the first bearing member having a first receiving part; and a second bearing member movably supported by the casing, the second bearing member having a second receiving part, wherein the first bearing member and the second bearing member rotatably support the charging roller shaft and are configured to urge the charging roller shaft toward the photosensitive drum such that a peripheral surface of the charging roller body contacts the peripheral surface of the photosensitive drum, the first end portion of the separating member further comprises a first extending portion extending in the longitudinal direction, the second end portion of the separating member further comprises a second extending portion extending in the longitudinal direction, when the separating member is attached to the casing of the cartridge, the first receiving part of the first bearing member receives the first extending portion, the second receiving part of the second bearing member receives the second extending portion, the first bearing member and the second bearing member move away from the peripheral surface of the photosensitive drum, and the peripheral surface of the charging roller body is separated from the peripheral surface of the photosensitive drum.

7. The image forming apparatus according to claim 1, wherein the separating member is made of resin.

* * * * *